US006651937B1

(12) United States Patent
Wilson

(10) Patent No.: US 6,651,937 B1
(45) Date of Patent: Nov. 25, 2003

(54) EXPANDABLE TRANSFORMABLE GUTTER BRACKET

(76) Inventor: Dennis E. Wilson, 240 Desha Rd., Lexington, KY (US) 40502

( * ) Notice: Subject to any disclaimer, the term of this patent is extended or adjusted under 35 U.S.C. 154(b) by 0 days.

(21) Appl. No.: 10/141,272

(22) Filed: May 8, 2002

(51) Int. Cl.[7] ..... E04D 13/064

(52) U.S. Cl. ..... 248/48.1; 248/304; 248/305; 248/306; 248/307

(58) Field of Search ..... 248/48.1, 48.2, 248/304, 305, 306, 307; 52/713, 715, 714, 11

(56) References Cited

U.S. PATENT DOCUMENTS

| | | | | | |
|---|---|---|---|---|---|
| 78,617 | A | | 6/1868 | Stine | |
| 302,358 | A | | 7/1884 | Rock | |
| 435,173 | A | | 8/1890 | Forbes | |
| 658,502 | A | | 9/1900 | Laird | |
| 664,637 | A | | 12/1900 | Heib | |
| 707,941 | A | | 8/1902 | Pope | |
| 813,826 | A | | 2/1906 | Rau | |
| 869,195 | A | * | 10/1907 | Patchin | 248/48.2 |
| 1,478,837 | A | | 12/1923 | Rachlin | |
| 1,593,139 | A | | 7/1926 | Rachlin | |
| 1,630,935 | A | | 5/1927 | Geiser | |
| 1,632,036 | A | * | 6/1927 | Mullen | 248/48.1 |
| 1,781,085 | A | | 11/1930 | Skinner | |
| 2,132,587 | A | | 10/1938 | Steckler | |
| 2,147,799 | A | * | 2/1939 | Reynolds | 248/48.2 |
| 2,349,467 | A | | 5/1944 | Scott | |
| 2,365,971 | A | | 12/1944 | Rachlin | |
| RE22,992 | E | | 3/1948 | Rachlin | |
| 2,912,991 | A | * | 11/1959 | Shinn | 135/68 |
| 3,006,321 | A | * | 10/1961 | Bailey | 119/61 |
| 3,874,131 | A | * | 4/1975 | Webster | 52/11 |
| 4,258,510 | A | | 3/1981 | Guiana | |
| 4,608,786 | A | | 9/1986 | Beam | |
| 4,631,875 | A | * | 12/1986 | Olson | 52/12 |
| 4,893,961 | A | * | 1/1990 | O'Sullivan et al. | 403/232.1 |
| 5,111,632 | A | * | 5/1992 | Turner | 52/702 |
| 5,184,435 | A | * | 2/1993 | Sherman | 52/12 |
| 5,303,521 | A | * | 4/1994 | Jansen | 52/94 |
| 5,327,689 | A | * | 7/1994 | Jansen | 52/11 |
| 5,335,469 | A | * | 8/1994 | Stuart | 52/655.1 |
| 5,437,138 | A | | 8/1995 | Tuohey et al. | |
| 5,456,441 | A | | 10/1995 | Callies | |
| 5,649,681 | A | * | 7/1997 | Faye | 248/48.1 |
| 5,687,936 | A | * | 11/1997 | Wilson | 248/48.2 |
| 5,819,494 | A | * | 10/1998 | Haisch | 52/696 |
| 6,212,837 | B1 | | 4/2001 | Davis et al. | |
| 6,226,956 | B1 | | 5/2001 | Davis et al. | |
| 6,367,743 | B1 | * | 4/2002 | Iannelli | 248/48.2 |

OTHER PUBLICATIONS

Berger Bros Co., Feasterville, Penn., http://www.berger-bros.com/products_drainange.html, http://www.berger-bros.com/products_halfround.html (printed Dec. 16, 2002).

* cited by examiner

*Primary Examiner*—Leslie A. Braun
*Assistant Examiner*—Amy J. Sterling
(74) *Attorney, Agent, or Firm*—Frost Brown Todd LLC

(57) ABSTRACT

An expandable gutter bracket having a gutter support arm is connected to a centrally disposed onto mounting portion, or web, with two spaced apart flanges extending substantially perpendicularly from opposing edges of the mounting portion, in the direction opposite the gutter support arm. The distance between the flanges is selectively provided by the mounting portion to be approximately equal to the thickness of a rafter extension and may be substantially parallel or slightly angled in order to provide a frictional fit on a rafter extension. Various configurations of the mounting portion are provided to select the appropriate thickness, including a plurality of attachments that pass through the gutter support arm and connect to each end of the flanges or two respective halves of a two-piece web.

15 Claims, 6 Drawing Sheets

EXPANDABLE TRANSFORMABLE GUTTER BRACKET

FIELD OF THE INVENTION

The present invention relates generally to a gutter bracket for holding a water-retaining gutter of the type conventionally found along the roof of a building, and is particularly directed to an adjustable gutter bracket which may be secured to a rafter extension rather than a soffit panel or a fascia panel of a building.

BACKGROUND OF THE INVENTION

Different buildings are designed and constructed with various roofing structures. Gutter assemblies are generally attached to the exterior surfaces of the roofing structures such that rainwater flowing from the roof is directed into the gutter. While some buildings are constructed with fascia panels or soffit panels covering the rafters, many architectural building types are constructed with exposed rafters and rafter extensions. Gutter brackets designed for attaching to fascia or soffit panel roofing structures are unsuitable for use with exposed rafters due to their shape, design, and mounting assemblies. Existing brackets that are mounted on rafter extensions must be affixed either to the end of the rafter extension or to one side of the rafter extension. Obviously, end attachments and single-side attachments to a rafter extension are not as secure as attachments that are secured to both sides of a rafter extension. The brackets that are attached to the end of the rafter extension are generally screwed or nailed into the end grain of the wood, at the end of the rafter extension. Those attachments are temporary and undesirable because nails and screws pointed in the direction of the wood grain tend to fall out due to the lack of wood grain resistance. Similarly, the brackets that attach to only one side of the rafter may detach due to inadequate fastening. Moreover, the single-side fastening brackets are generally designed with the gutter support arm too close to the side of the rafter extension,fostering rotting and decay by the rainwater of the rafter extension and attached building. Other gutter brackets require attachment to the roof sheathing and therefore cannot be attached once the roof shingles are in place without having to remove the roof shingles. Analogously, the complex nature of the installation required for existing brackets pose problems when gutter systems or brackets are maintained, removed, or replaced.

In many applications, it is desirable to mount a gutter bracket on an exposed area that is in full open view. In those applications, it is imperative that the brackets have aesthetic value in order to be useful. However, many brackets that attach to a rafter extension have no aesthetic value and are designed to be concealed by other fixtures.

I solved these problems with a one-piece gutter bracket described in U.S. Pat. No. 5,687,936. In particular, my gutter bracket is intended for installation on roofs having rafter extensions for roofing structures without soffit or fascia panels. The simple, one-piece gutter bracket is capable of being mounted upon both sides of a rafter extension without soffit panels or fascia panels, providing an aesthetically pleasing method for installing gutters.

Although my one-piece gutter bracket provided numerous advantages over existing gutter brackets, I have noted in most instances that rafter extensions vary in thickness, orientation and clearance to other building structures. In addition, in some instances, it is desirable that the gutter bracket arm be displaced from a central mounting position from the end of the rafter extension.

Consequently, a significant and imperative need exists for an improved gutter bracket that can adjustably accommodate various types and sizes of rafter extensions.

BRIEF SUMMARY OF THE INVENTION

The present invention addresses these and other shortcoming in the prior art by providing a gutter bracket that adjustably expandably mounts to a rafter extension to accommodate rafter extensions of varying thicknesses. In addition, various configurations of the gutter bracket transformably accommodate various alignments and orientations of the rafter extension, including obstacles that may impede installation of a gutter bracket. Thereby, an improved gutter bracket system may be used on a wider variety of buildings.

In one aspect of the invention, a gutter bracket includes a gutter support arm for holding a conventional water-retaining, water-deflecting gutter. An expandable mounting portion of the bracket connects two flanges to one another and attaches to the gutter support arm. The flanges are configured for being affixed to each side of the rafter extension with the expandable mounting portion passing by a distal end of the rafter extension. The expandable mounting portion allows the flanges to be spaced to accommodate rafter extensions of various thicknesses.

In another aspect of the invention, a gutter bracket system is presented for mounting onto a building having rafter extensions that are not aligned or that are partially inaccessible due to structure. The gutter bracket system includes half brackets, each including a flange affix to one side of the rafter extension with a half web panel that orients a gutter support arm out of the plane of the affixed flange, such as a lateral offset or an angled (rather than parallel) arrangement. Thereby, the half brackets may be used in combination or singularly as required to install a gutter system onto the entire building, to include hip rafters, rafters with an obstacle aligned with the end of the rafter, and rafters up against a wall on one side.

In yet another aspect of the invention, a gutter bracket includes a cleated attachment between the flanges that are attached to the rafter extension and to the gutter support arm that supports the gutter. Thereby, the gutter support arm is readily attachable and detachable to the building. This allows additional flexibility when access is required to the rafter extension. Moreover, gutter systems may choose to mount a plurality of gutter bracket arms to a length of gutter, utilizing the cleated attachment as a means of installing or uninstalling the length of gutter as a unit. With this added flexibility, a user may choose to partially detach a cleated attachment to allow the length of gutter to droop, enhancing access for cleaning.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims. These and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
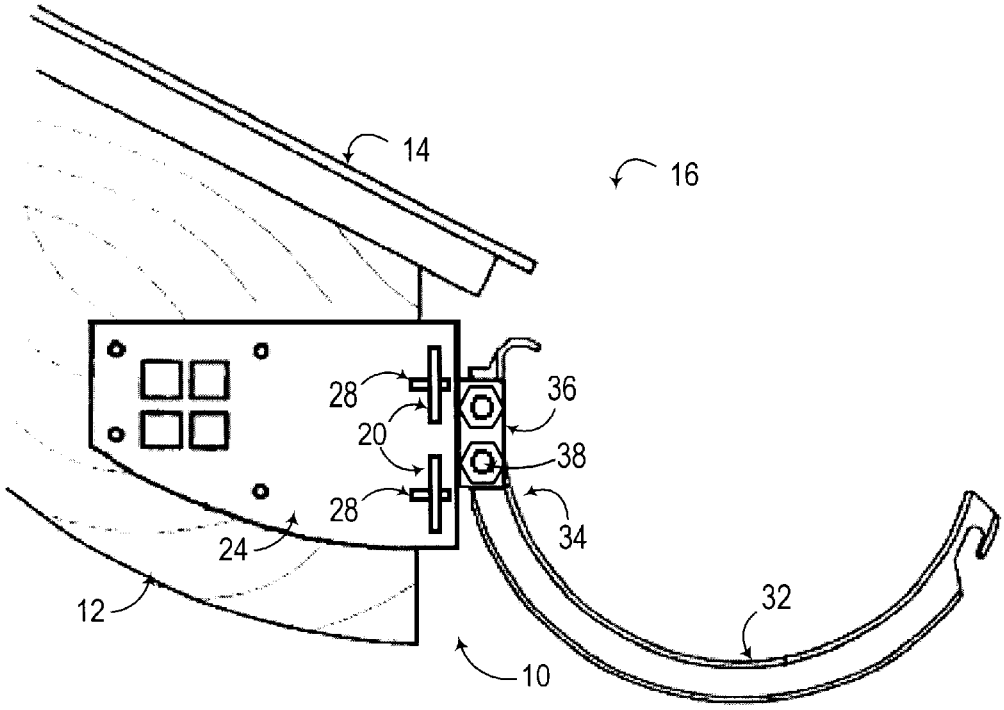
FIG. 1 is a side view of a first version of a gutter bracket, showing the device as expandably used on a rafter extension of a nonstandard thickness.
Figure 2:
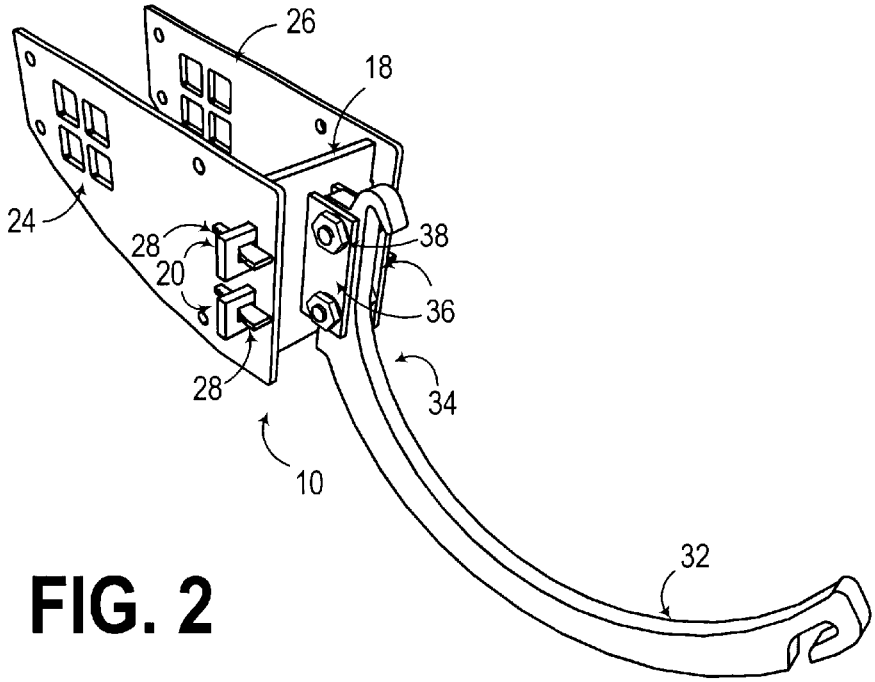
FIG. 2 is an upper perspective view of the gutter bracket of FIG. 1, showing an expandably assembled web, with the gutter support arm centrally attached thereon.
Figure 3:
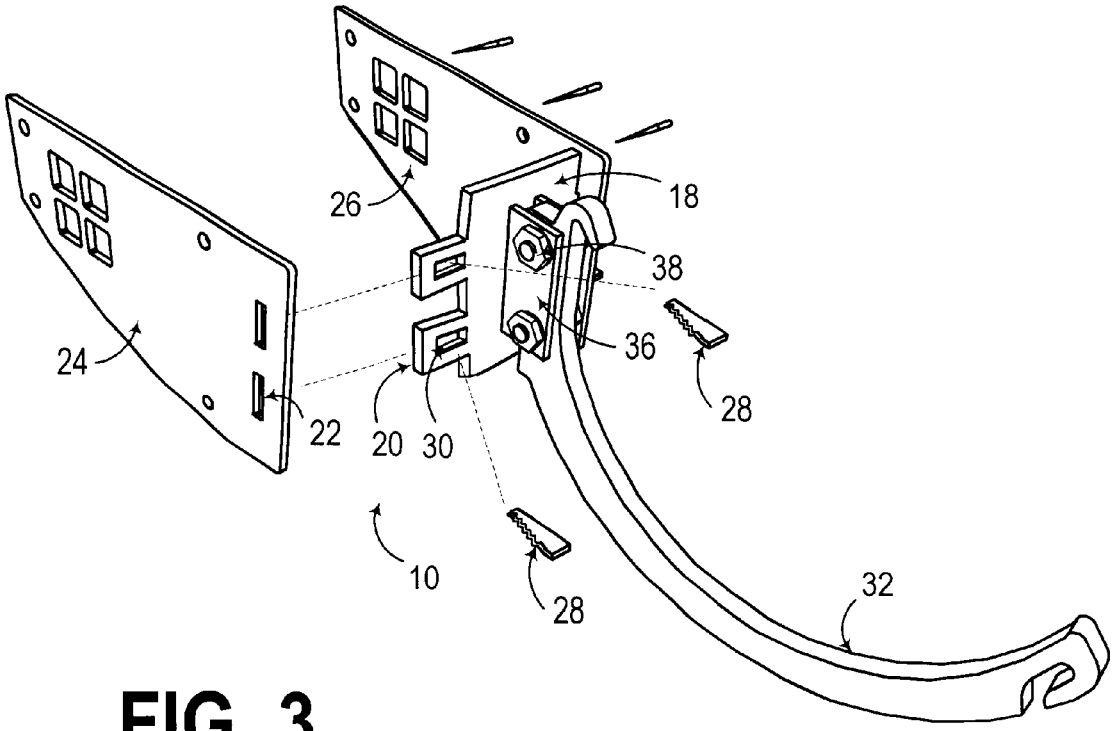
FIG. 3 is a partially exploded upper perspective of the gutter bracket of FIG. 2, showing lateral tabs for expandable insertion into slots of the flange.

Referring now to the drawings in detail, wherein like numerals indicate the same elements throughout the views, FIGS. 1–3 depict a first version of a gutter bracket 10 consistent with the present invention for expandably mounting a rafter extension and for enhanced positioning of a gutter. The gutter bracket 10 is depicted as mounted to a rafter extensions 12 that supports roofing 14 of a building 16. The gutter bracket 10 includes an expandable web, depicted as a tabbed panel 18, that accommodates variations in thickness of the rafter extension 12. In particular, lateral tabs 20 project through tab slots 22 in respective left and right flanges 24, 26 of the bracket 10. Thereby, each flange 24, 26 may be attached (e.g., fastened, adhered, etc.) to opposing sides of the rafter extension 12. The range in spacing accommodated by the bracket 10 may be selected by the lateral length of the lateral tabs 20. With particular reference to FIG. 2, locking members, depicted as a ratcheting wedges 28, are selected with an appropriate length and slope to lock in the outwardly exposed portion of wedge slots 30, which are horizontally disposed in each respective lateral tab 20.

A gutter support arm 32 is shaped to support a portion of a semi-circular water retaining, water deflecting gutter, although it will be appreciated that the arm 32 and the gutter may be of various cross sectional shapes (e.g., rectangular). A proximal end 34 of the support arm 32 is secured by a plurality of connections to the tabbed panel 18. Two arm grasping flanges 36 distally project from the tabbed panel 18 to embrace each side of the proximal end 34 (i.e., back end) of the support arm 32, secured by fasteners 38. It will be appreciated that the support arm 32 may be attached in other manners, such as by forming or welding the arm 32 and tabbed panel 18 into a single piece, or by a single connection with sufficient contact between arm 32 and panel 18 to prevent downward pivoting.

It will be appreciated that the illustrative embodiment depicted includes symmetrical lateral tabs 20, increasing the overall expandability. However, it should be appreciated that the tabbed panel 18 may be fabricated as attached on one lateral side to one of the flanges with lateral tabs expandably engaging the other, detached flanges. In addition, any number of lateral tabs may be selected, such as one or three on each lateral side. In addition, other shaped wedge slots and ratcheting wedges may be used. For instance, for a given building, all of the rafter extensions may be of a predetermined size with in a range of thickness for which the gutter bracket may be expanded. The wedges may then be a frictional member of the desired cross sectional size that is only sized for the predetermined size.

Figure 4:
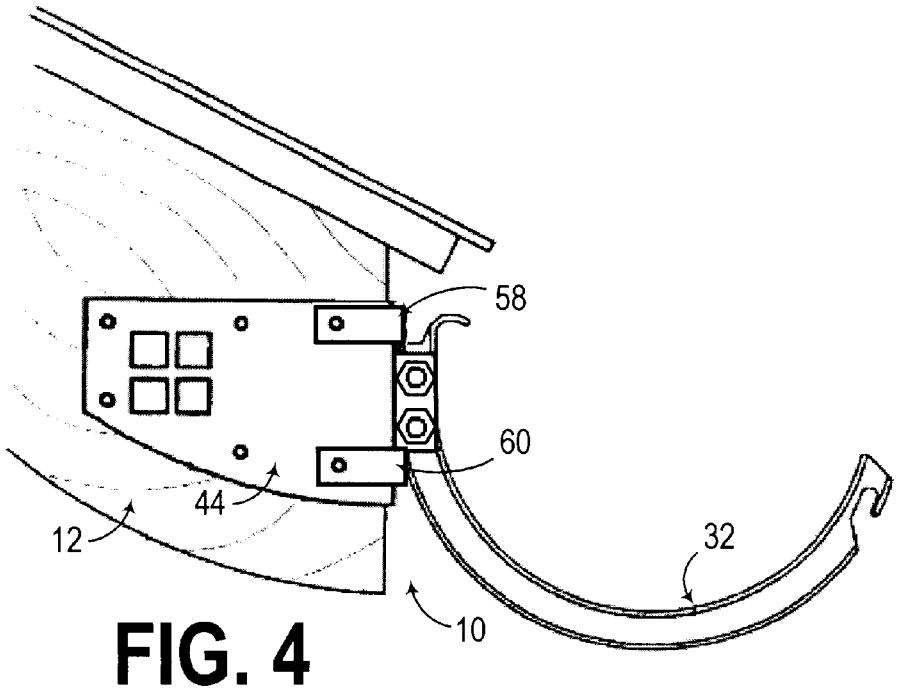
FIG. 4 is a side view of a second version of a gutter bracket, showing two half brackets as expandably used on the rafter extension of a nonstandard thickness.
Figure 5:
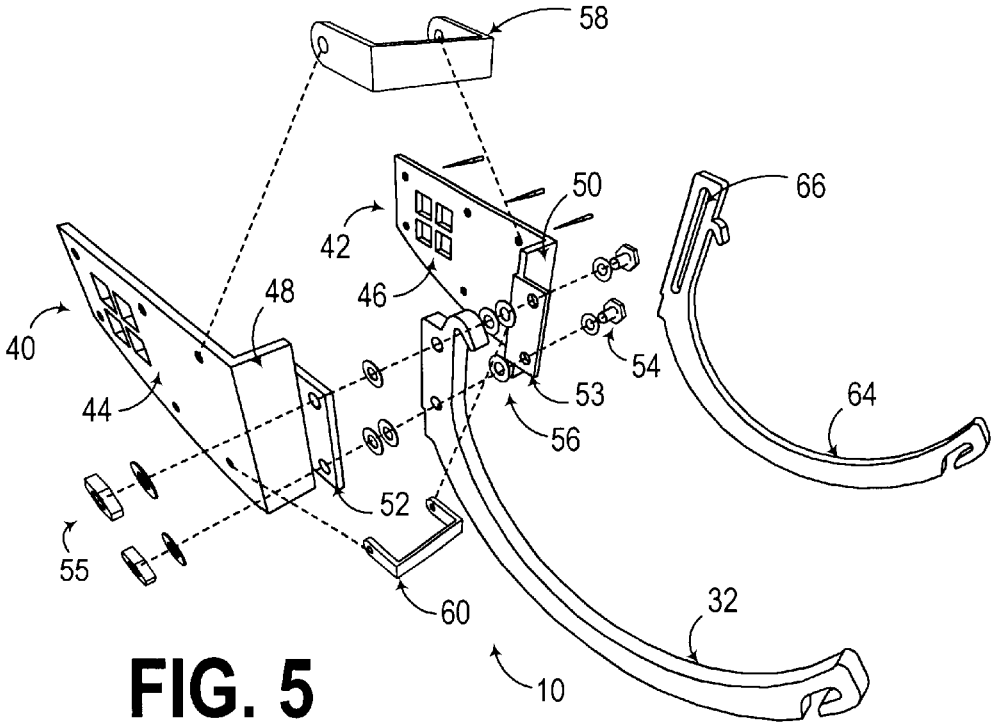
FIG. 5 is an exploded upper perspective view of the gutter bracket of FIG. 4.

FIGS. 4–5 depict a second version of the gutter bracket 10, which includes an alternative approach to expandability for various thicknesses of rafter extensions 12. Two opposing half brackets 40, 42 are each comprised of perpendicularly disposed pair of a flange 44, 46 and half web panel 48, 50, respectively. With the bracket 10 divided into two opposing half brackets 40, 42, may advantageously grip a support arm 32 of varying thickness between respective arm grasping flanges 52, 53. Additional lateral expansion is provided by selecting fasteners, depicted as hex-head bolts 54 and nuts 55, of appropriate length with an appropriate number of spacers, depicted as washers 56. Placement of an unbalanced number of washers 56 on each side of the bracket arm 32 may be used to compensate when the rafter extension 12 is twisted from the vertical, to thereby achieve a vertical support arm 32.

Additional support between the two half brackets 40, 42 is provided by top and bottom strengthening bands 58, 60, which wrap from the left flange 44 of the left half bracket 40, across both half web panels 48, 50, and onto right flange 46. Each strengthening band 58, 60 is fastened to the rafter extension 12 along with the flanges 44, 46. The lower strengthening band contacts a band recess 62 in a lower portion of the proximal end 34 of the support arm 32, thereby reacting pivoting loads to support the fasteners 52.

A support arm 64 with a continuously adjustable vertical slot 66 in the proximal end 34 is depicted as an alternate to the support arm 32. The vertical adjustment provided by the slot 66 provides additional flexibility after installing the half brackets 40, 42. For instance, a uniform height for all half brackets 40, 42 may be desirable for aesthetics, for achieving secure attachment to the rafter extension, or to simplify installation. Thereafter, the desired slope of the supported gutter may be achieved by selecting the appropriate position of the vertical slot 66. Proper slope assists in diverting water and debris to a gutter down spout.

Figure 6:
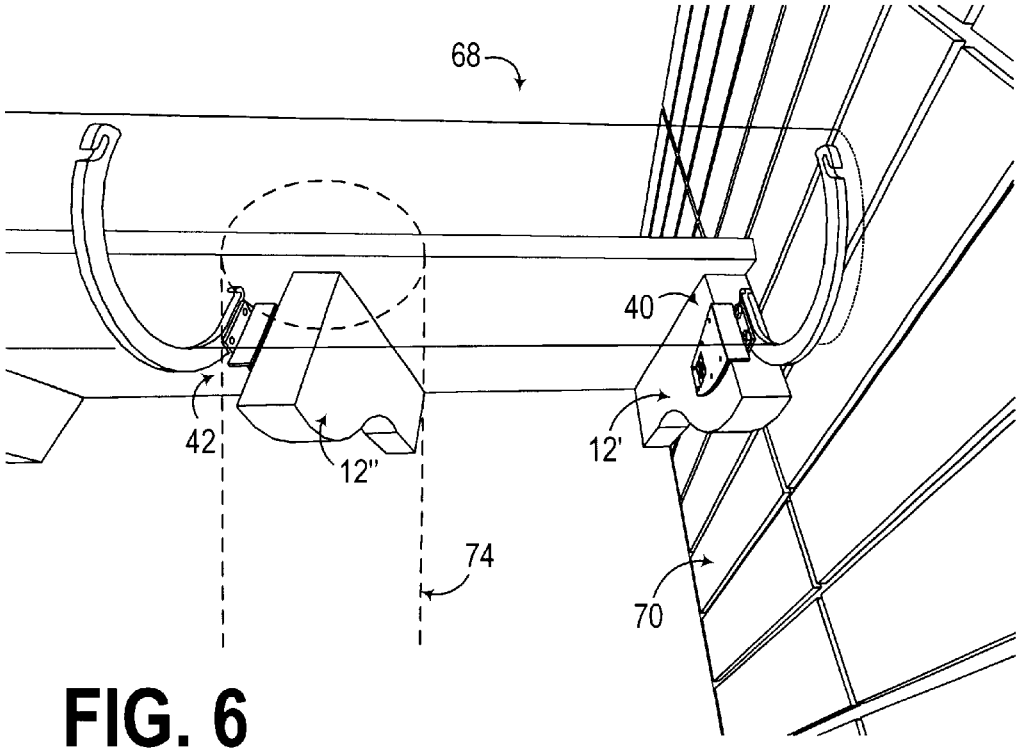
FIG. 6 is a lower perspective of a section of gutter pipe transformably supported in two instances by half brackets of FIGS. 4–5 to avoid obstacles.

The half brackets 40, 42 advantageously become part of a transformable gutter bracket system 68, as illustrated on FIG. 6. Full brackets 10, such as in FIG. 4, are used where a rafter extension 12 is unimpeded and aligned with the desired placement of the gutter bracket arm 32. However, in instances such as rafter 12', use of a half bracket 40 on its usual side is warranted since the other side of the rafter 12' is impeded by structure, depicted as an adjoining wall 70. The half web panel 48 of half bracket 40 advantageously contacts a distal end 72 (i.e., front end) of the rafter 12' to assist in reacting the pivoting load from the corresponding support arm 32'.

A rafter 12" illustrates another impediment, depicted as a gutter down spout 74 (shown in phantom), which blocks installation of gutter support arm 32" in line with the rafter 12". However, by using a half bracket 42 on side opposite its typical placement, an offset is achieved. The half bracket 42 reacts the load from the support arm 32' solely through its side attachment to the rafter 12", and its half web panel 50 does not contact the distal end 72 for additional support. However, this is often preferable to having no gutter bracket support from the rafter 12".

Figure 7:
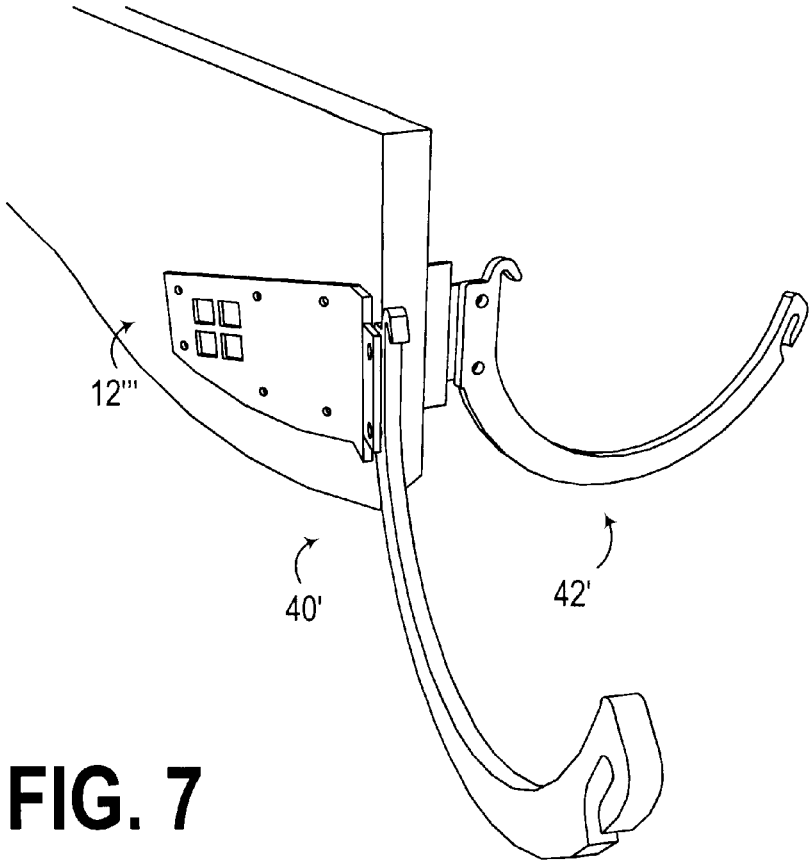
FIG. 7 is an upper perspective view a third version of a gutter bracket, depicting two instances of angled, half-brackets used at a hip ridge rafter extension.

FIG. 7 depicts further transformable capability of half brackets 40', 42' achieved by flaring the half bracket 40, 42 of FIG. 6 from a parallel (flange to arm gripping flange) shape to an obtuse angle such as 135 degrees for a third version of the gutter bracket 10. Thereby, a convex corner of the roof, or hip, may include two brackets 40', 42' from each side of a diagonal hip rafter 12'", with one bracket 40', 42' on each side of a 90 degree turn in the gutter. Similar approaches may be used for changes in the roofline other than perpendicular corners. Thus, the gutter bracket system 68 is given additional applications.

Figure 8:
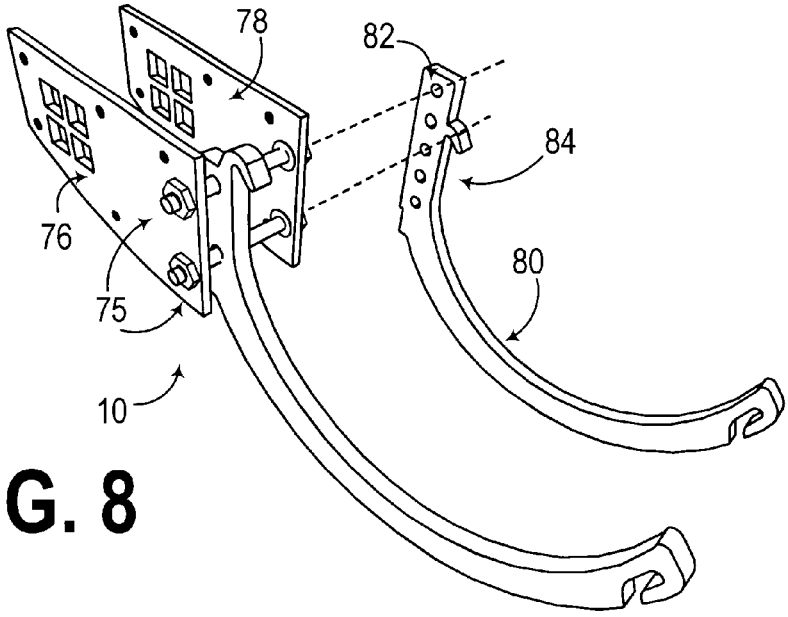
FIGS. 8–10 are upper perspectives of a fourth version of a gutter bracket, illustrating various configurations of a pinned web.
Figure 9:
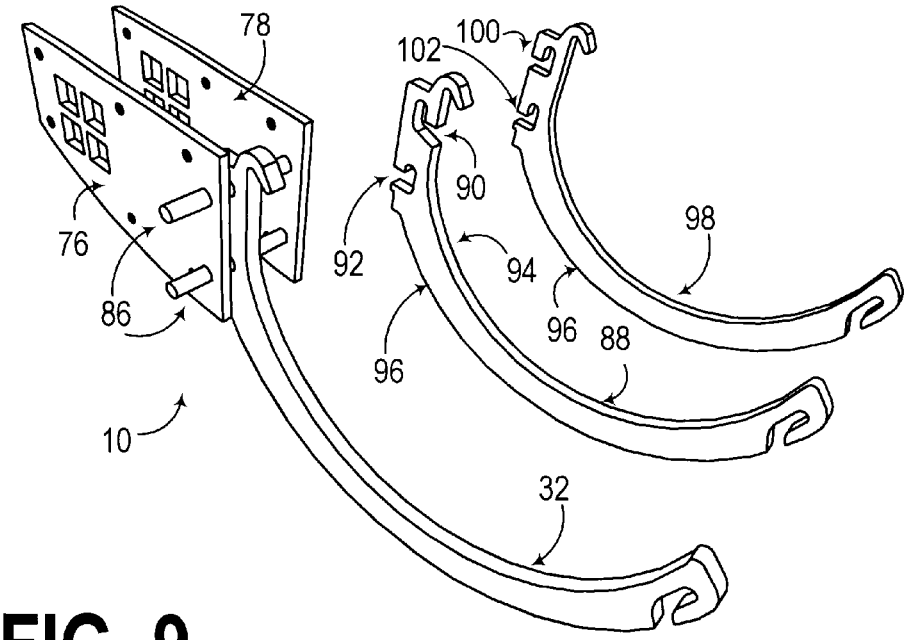
Figure 10:
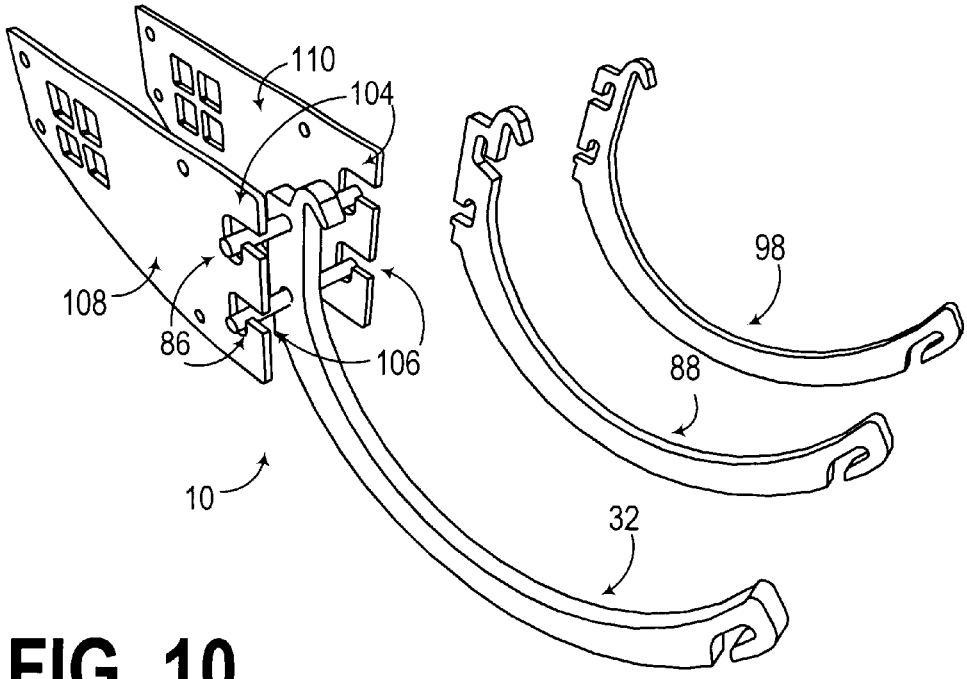

FIGS. 8–10 depicts a fourth version of the gutter bracket 10 wherein a plurality of elongate members, depicted as bolt attachments 75 in FIG. 8, form the expandable web by passing through the support arm 32 and a pair of opposing flanges 76, 78. Another alternate support arm 80 is depicted with a vertical series of holes 82 in its proximal end 84 for providing vertical adjustment. The gutter brackets 10 of FIGS. 8–10 further illustrate additional flexibility in the installation of a gutter bracket system 68. For instance, the gutter support arm 32 is off center between flanges 76, 78 in FIG. 8, as may be appropriate when only a small amount of offset is desirable. The bolt attachments 74 of FIG. 8 also assembly before or after the flanges 76, 78 are attached to the rafter.

Similarly, FIG. 9, depicts the elongate members between flanges 76, 78 as a pinned attachment 86, which could include ends that are crimped after insertion through the arm 32 and flanges 76, 78 to prevent coming apart. The pinned attachment 86 may advantageously be installed without the support arm 32, and instead use support arm that are hooks onto the pinned attachment 86. For instance, a first cleated support arm 88 has opposing cleats 90, 92, with the top cleat 90 on the inward edge 94 of the arm 88 and the bottom cleat 92 on the outward edge 96 of the arm 88. The pivoting load at the cleats 90, 92 is thus in the direction opposite of installation, providing a very strong attachment, although necessitating clearance between the pinned attachment 86 and the distal end 72 of the rafter 12. The second cleated support arm 98 has top and bottom cleats 100, 102 that are both on the outward edge 96 of the support arm 98, simplifying installation with pinned attachment 86 close to the rafter 12. The cleated support arms 88, 98 simplify removal of the bracket arms. In addition, should the bracket arms 88, 98 be incorporated or affixed to a length of gutter, a length of gutter may be installed or lowered for cleaning without having to individually attend to each bracket 10. FIG. 10 depicts inclusion of top and bottom pairs of cleats 104, 106 in flanges 108, 110, thus simplifying installation and removal of the pinned attachment 86 and the bracket arm 32.

In use, the gutter bracket system 68 may be used in a variety of applications of buildings 16 that have rafter extensions proximate to the desired placement of gutters. The right and left flanges 40, 42 of the bracket 10 are expandably spaced to attachment to rafter extensions 12 of varying thicknesses. The expandable web that connects the flanges 24, 26 to one another and the gutter support arm 32, 64, 88, 98 may advantageously be chosen for various features. A tabbed panel 18 provides strong contact between the pivoting loads of the arm 32 and the flanges 24, 26 and distal end 72 of the rafter 12. Alternatively, half brackets 40, 42 may be used together or individually. As yet a further alternative, a pinned attachment 86 between flanges 108, 110 expandably attaches to the rafter extensions 12 as well as giving various options for attachment of cleated support arms 88, 98.

Figure 11:
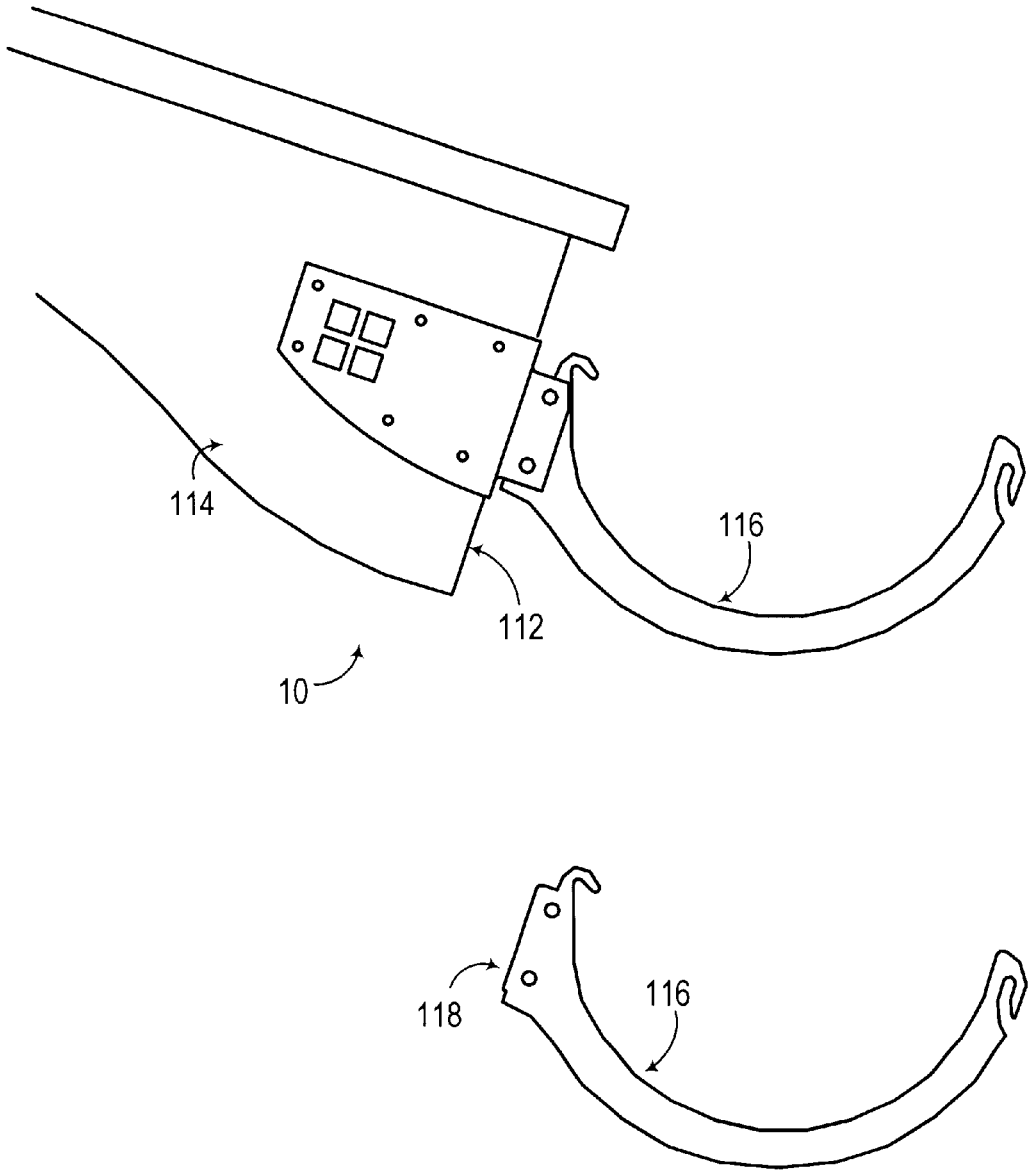
FIG. 11 is a side view of a gutter bracket with an angled gutter support arm for installation on a sloped distal end of a rafter extension.

FIG. 11 depicts a gutter bracket 10 mounted on a downward facing distal end 112 of a rafter extension 114. A gutter support arm 116, shown both assembled and removed, includes an angled proximal end 118 that compensates for the downward slope of the distal end 112 of the rafter extension 114. Thereby, a gutter may be installed that transversely level. It will be appreciated the angle of the proximal end 118 may be fabricated or adjusted for a range of angles to accommodate various installations of rafter extensions 114.

By virtue of the foregoing, a bracket 10 for mounting gutters to rafter extensions 12 is provided that is expandable to various dimensions of rafter extensions 12, is adjustable to rafter extensions 12 twisted from the vertical, and obstructed rafter extensions 12', 12".

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For instance, the various components in the illustrative embodiments are generally formed by abrasive water jet cutting or die stamping from sheet metal (e.g., copper, aluminum, stainless steel) and thereafter bending to the desired angles. However, gutter brackets may be formed from other alloys as well as nonmetallic materials. Moreover, these components may be assembled, cast, molded or otherwise formed to achieve the desired shapes. As another example, the various components may be fastenened/affixed/attached to one another and to the rafter extension in various manners, which include but are not limited to through bolts, bent-over tabs, chemically cured adhesives, thermoplastics, pins, rivets, brazed attachment, welded attachment, etc.

What is claimed is:

1. A gutter bracket for a rafter extensions with two side surfaces and a distal end surface, the rafter extension having a thickness between the two side surfaces selected from a range of thicknesses, the gutter system comprising:

a left flange and a right flange, each configured for affixing to respective side surfaces of the rafter extension;

a tabbed panel that slidingly engages at least one flange and engages the other flange to traverse the distal end surface of the rafter extension;

a locking member between the tabbed panel and the at least one flange that is slidingly engaged;

a pair of arm grasping flanges distally projecting from the tabbed panel;

first and second elongate members each coupled across the pair of distally projecting arm grasping flanges; and a gutter support arm having a proximal end and a distal end, the proximal end including apertures configured to respectively receive the first and second elongate members.

2. A gutter bracket for a rafter extensions with two side surfaces and a distal end surface, the rafter extension having a thickness between the two side surfaces selected from a range of thicknesses, the gutter system comprising:

a left flange and a right flange, each configured for affixing to respective side surfaces of the rafter extension;

first and second elongate members each coupled across the distal end of the rafter extension to a distal portion of each flange; and a gutter support arm having a proximal end and a distal end, the proximal end including apertures configured to respectively receive the first and second elongate members.

3. The gutter bracket of claim 2 wherein the left and right flanges each further comprise:

a half web panel perpendicularly forming a corner of the flange registered to cover a portion of the distal end of the rafter extension; and distally projecting arm grasping flange forming the distal portion of the flange for receiving the elongate members.

4. The gutter bracket of claim 2, wherein the distal end surface of the rafter extension has a downward slope, the gutter support arm including an angled proximal end to compensate for the downward slope.

5. The gutter bracket of claim 3, wherein the distally projecting arm grasping flanges include more than two vertically aligned apertures to enable selective vertical positioning of the gutter support arm.

6. The gutter bracket of claim 3, wherein the apertures of the proximal end of the gutter support arm comprise a vertical slot.

7. The gutter bracket of claim 3, wherein the apertures in the proximal end of the gutter support arm comprise more than two vertically aligned apertures to enable selective vertical positioning of the gutter support arm.

8. The A gutter bracket system, for mounting to a plurality of rafter extensions of a building, each rafter extension with two side surfaces and a distal end surface, the rafter extension having a thickness between the two side surfaces selected from a range of thicknesses, the plurality of rafter extensions including an unobstructed rafter extension and an obstructed rafter extension, the gutter bracket system comprising:

a first bracket for mounting to the unobstructed rafter extension, comprising:

a gutter support arm having a distal end and a proximal end, a left half bracket having a left flange configured for attachment to a left side surface of the unobstructed rafter extension and a half web panel perpendicularly affixed to a distal portion of the left flange to cover a portion of the distal end of the unobstructed rafter extension, the half web panel including an arm grasping flange, a right half bracket having a right flange configured for attachment to the right side surface of the unobstructed rafter extension and a half web panel perpendicularly affixed to a distal portion of the right flange to cover a portion of the distal end of the unobstructed rafter extension, the half web panel including an opposing arm grasping flange, and an attachment coupling the arm grasping flanges and the proximal end of the gutter support arm; and a second bracket for mounting to the obstructed rafter extension selected from the group consisting of another left half bracket and another right half bracket;

wherein the obstructed rafter extension comprises a hip rafter extension angled to intersect a corner of a roofline of the building, the second bracket comprising a left half bracket wherein the arm gripping flange is angled perpendicular to the roofline to the left of the corner of the building, the gutter bracket system further including a third bracket comprising a right half bracket wherein the opposing arm gripping flange is angled perpendicular to the roofline to right of the corner of the building, both angled half brackets affixed to opposite sides of the hip rafter extension.

9. The gutter bracket of claim 2, wherein the apertures of the proximal end of the gutter support arm comprise cleated openings configured to hook onto elongate members respectively.

10. The gutter bracket of claim 9, wherein the cleated openings are both presented on a back surface of the proximal end of the gutter support arm.

11. The gutter bracket of claim 9, wherein the cleated openings comprise a top cleated opening presented on a back surface of the proximal end of the gutter support arm and a bottom cleated opening presented on a front surface of the proximal end of the gutter support arm.

12. The gutter bracket of claim 2, wherein each distal portion of the right and left flanges present aligned cleated opening for detachably receiving respective elongate members.

13. The gutter bracket of claim 2, wherein the elongate members comprise pins.

14. The gutter bracket system of claim 2, wherein the elongate members comprise bolt attachments.

15. A gutter bracket system for mounting to a hip rafter extension angled to intersect a corner of a roofline of a building and having two side surfaces and a distal end surface, the rafter extension having a thickness between left and right side surfaces selected from a range of thicknesses, the gutter bracket system comprising:

a left bracket, comprising:

a left flange configured for attachment to the left side surface of the hip rafter extension, and a gutter support arm coupled to the left bracket at an angle perpendicular to the roofline to the left of the corner of the building; and a right bracket, comprising:

a right flange configured for attachment to the right side surface of the hip rafter extension, and a gutter support arm coupled to the left bracket at an angle perpendicular to the roofline to the right of the corner of the building.

* * * * *